US005232141A

United States Patent [19]

Mittmeyer et al.

[11] Patent Number: 5,232,141

[45] Date of Patent: Aug. 3, 1993

[54] SUCTION ROLLER ARRANGEMENT FOR TRANSPORTING WEB-FORM MATERIAL

[75] Inventors: Joachim Mittmeyer, Neuried; Waldemar Urschel, Maisach; Johann Baarfüsser, Gauting; Lothar Langer, Munich; Rainer Röhlig, Radevormwald, all of Fed. Rep. of Germany

[73] Assignee: BASF Magnetics GmbH, Fed. Rep. of Germany

[21] Appl. No.: 841,878

[22] Filed: Feb. 26, 1992

Related U.S. Application Data

[63] Continuation of Ser. No. 599,675, Oct. 17, 1990, abandoned.

[30] Foreign Application Priority Data

Nov. 1, 1989 [DE] Fed. Rep. of Germany ..... 3936286

[51] Int. Cl.[5] ..... G65H 20/12

[52] U.S. Cl. ..... 226/95; 226/190

[58] Field of Search ..... 226/7, 93, 95, 97, 190, 226/196

[56] References Cited

U.S. PATENT DOCUMENTS

| | | | |
|---|---|---|---|
| 3,172,321 | 3/1965 | Schrader | 226/95 X |
| 3,268,766 | 8/1966 | Amos | 226/95 X |
| 3,416,149 | 12/1968 | Stahler | 226/95 X |
| 3,587,962 | 6/1971 | Herzhoff et al. | 226/95 |
| 4,142,661 | 3/1979 | Nettles et al. | 226/97 |
| 4,207,998 | 6/1980 | Schmid | 226/95 |
| 4,506,841 | 3/1985 | Hood | 226/97 X |
| 4,888,848 | 12/1989 | Serracant-Clermant et al. | 226/95 X |
| 4,919,319 | 4/1990 | Ford et al. | 226/97 X |

FOREIGN PATENT DOCUMENTS

| | | | |
|---|---|---|---|
| 0376127 | 7/1990 | European Pat. Off. | 226/95 |
| 0226541 | 8/1985 | Fed. Rep. of Germany | 226/97 |
| 0052350 | 5/1981 | Japan | 226/97 |
| 0043757 | 3/1984 | Japan | 226/95 |
| 0267648 | 11/1988 | Japan | 226/97 |
| 0747285 | 3/1956 | United Kingdom | 226/95 |
| 983951 | 2/1965 | United Kingdom . | |

OTHER PUBLICATIONS

IBM Technical Disclosure Bulletin, "Air Bearing for Web Lubrication", A. H. Bell, May 1966.

*Primary Examiner*—Daniel P. Stodola
*Assistant Examiner*—Paul T. Bowen
*Attorney, Agent, or Firm*—Connolly and Hutz

[57] ABSTRACT

A suction roller arrangement for transporting web-form material consisting of a roller body in the form of a hollow cylinder of porous sintered metal, the inner space beneath the looping angle of the web being under reduced pressure. The problem of converting the torque required to transport the web with minimal reduced pressure while, at the same time, protecting the surface of the web is solved by making the pore diameter in the middle cylindrical zone of the roller larger than in the two peripheral zones and by giving the outer cylinder surface of the roller a smooth surface finish by lathe-turning, grinding and polishing. The stator in the inner space of the rotatable roller is polygonal in shape in the region of the looping angle and has different distances from the rotor.

10 Claims, 2 Drawing Sheets

SUCTION ROLLER ARRANGEMENT FOR TRANSPORTING WEB-FORM MATERIAL

CROSS-REFERENCE TO RELATED APPLICATIONS

This application is a continuation of the copending U.S. application Ser. No. 07/599,675 filed Oct. 17, 1990 by Joachim Mittmeyer, Waldermar Urshel, Johann Baarfüsser, Lothar Langer and Rainer Röhlig for Suction Roller Arrangement for Transporting Web-form Material, now abandoned.

FIELD OF THE INVENTION

This invention relates to a suction roller arrangement for transporting web-form material, more particularly a magnetic coating cast onto a plastic layer support, comprising a rotatably mounted roller body in the form of a hollow cylinder of porous sintered metal, the space beneath the looping angle of the web being under reduced pressure.

BACKGROUND OF THE INVENTION

Suction rollers of the type in question are used, for example, to convert a torque into a tractive force in webs of material in coating machines, for example for coating photo paper, film or magnetic tape, when the static friction between the transfer roller and the web is inadequate.

In known suction rollers in which the sealing element arranged in the suction roller internally covers that part of the roller around which the web is not looped with a slight overlap, air leaks through the perforation of the casing into the sealing gap between the casing and the sealing segment and causes the web to flutter undesirably at the points where it runs onto and leaves the suction roller, so that the web is not smoothly transported. To eliminate this deficiency, DE 14 74 973 proposes an inner ring element consisting of two chambers in which that part around which the web is looped is under reduced pressure while the other part is under atmospheric pressure, reductions in cross-section being provided between the two chambers.

It is already known from GB-PS 983 951 that the roller itself can be provided with a permeable casing. This casing remains partly free during the transport of a web of material so that, because the entire periphery of the roller casing has to be placed under vacuum, an unusually high vacuum and, hence, considerable energy are necessary. For this reason, mask arrangements are proposed for peripheral adaptation to the width of a web. This is complicated and does not exactly cover the peripheral regions. In addition, the effort involved in operation is considerable, the guiding of the web, particularly at its borders, is unstable and, because of the accessibility, dirt is sucked in. In addition, problems arise in regard to the vacuum to be applied because no indentations should be formed in the covered part of the roller casing which consists of porous material, for example sintered material. Apart from this, however, that part of the roller casing around which the web of material is not looped is always free so that the porous roller casing gradually becomes blocked. Periodic cleaning is therefore necessary and necessitates dismantling of the suction roller arrangement.

These disadvantages are said to be avoided by the suction roller arrangement described in DE 31 11 194. In this suction roller arrangement, longitudinal grooves are arranged at intervals from one another in the outer surface of the cylindrical roller and are covered by strips of air-permeable material. At its ends, the roller is covered by wear disks which are fixed to the roller and onto each of which a sealing ring is pressed under spring tension. The inner space beneath the looping angle of the web-form material is under reduced pressure while the space around which the web is not looped is fed through openings in the sealing rings with compressed air which lifts the web of material off the roller and, at the same time, is intended to blow dirt which has been sucked in out of the porous strips. However, an arrangement such as this is complicated and therefore expensive to make and, in addition, has the disadvantage that heavy wear can be expected at high rates of travel which shortens operating times and increases production costs.

SUMMARY OF THE INVENTION

Accordingly, the problem addressed by the invention was to improve a suction roller arrangement of the type mentioned at the beginning in such a way that a relatively low reduced pressure at the fan would be sufficient to achieve adequate adhesion between the suction roller and the web-form material, thus saving energy, dirt would not accumulate in the porous roller casing so that it did not become blocked, the roller arrangement would be true running, would be of simple construction and would allow long production times.

According to the invention, the problem as stated above was solved by a suction roller arrangement in which a hollow cylinder of porous sintered metal has pores of diameters ranging from 35 to 70 um in an axial central zone and pores of a diameter of 30 um or less in zones spaced axially away from the central zone so that the pores in the zones at the ends of the roller are smaller than the pores of the central zone.

The features of the invention are further explained in the following description taken together with the illustrations in the drawings. The invention is described in more detail in the following with reference to the accompanying drawings.

BRIEF DESCRIPTIONS OF THE FIGURES

DESCRIPTION OF THE INVENTION

Figure 2:
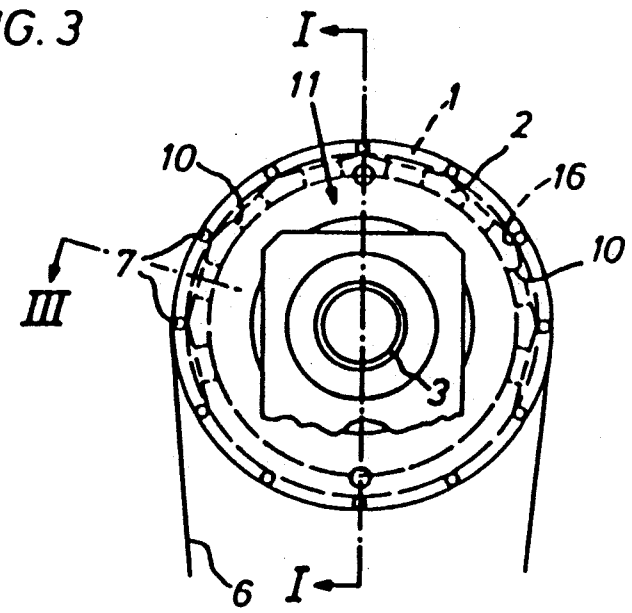
FIG. 2 is a cross-section through the corresponding arrangement.
Figure 3:
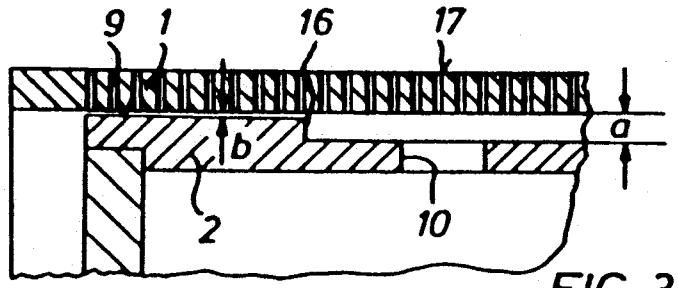
FIG. 3 is a longitudinal section through part of the arrangement on the line III of FIG. 2.
Figure 1:
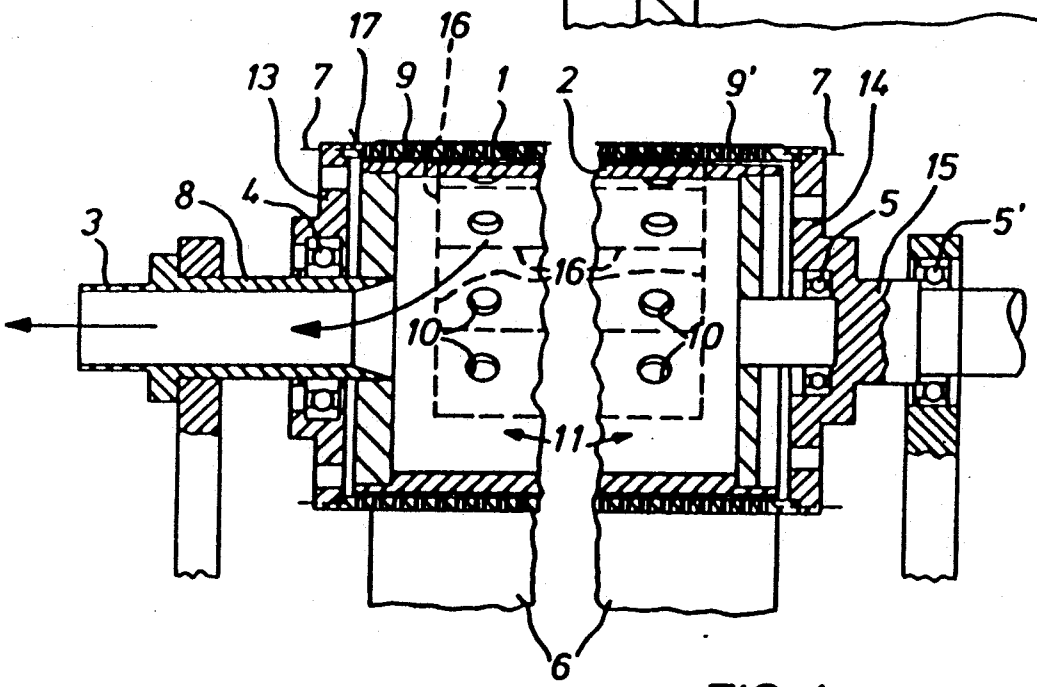
FIG. 1 is a longitudinal section through the suction roller arrangement according to the invention on the line I of FIG. 2.

In the embodiment illustrated, the suction roller arrangement consists of a roller body (1) in the form of a hollow cylinder, preferably of stainless VA steel, which at its ends is fixedly connected to the steel disks (13,14) by screws (7). The roller body is mounted for rotation on the shaft (8,15) by ball bearings (4,5,5'). It consists of porous sintered metal and is machined for true running from its external diameter to its internal diameter. The production of sintered metal is described, for example, in DE-OS 20 17 258. The roller body rotates about the stator (2) which, as shown in FIG. 2, is polygonal in shape in that part around which the web (6) of material is looped and is provided in the faces of the polygon with openings or holes (10) for transferring the intake air to the interior (11) of the stator whereas, in that part around which the web is not looped, it has a cylindrical outer surface with no holes. It is preferably made of aluminium. As shown in FIG. 3, the radial distance (a) from the rotor (1) and the faces of the polygon in the region of the holes (10) is approximately 10 mm and, at the edges (16) of the polygon and in the peripheral zones (9,9'), between 0.1 and 0.3 mm (b) so that very little air leaks in. According to the invention, the pore diameter of the sintered metal roller body (1) must be between 30 and 70 μm in the region of the polygon faces of the stator and preferably between 10 and 30 μm in the peripheral zones (9,9'). Through this design measure, there is less air resistance over the web transport zone than in the peripheral zones of the roller body, so that a relatively low reduced pressure nevertheless provides for adequate adhesion between suction roller and web. The considerably higher air resistance in the peripheral zones reduces the leaking air and improves the adhesion of the web at its borders. In a variant, the pore diameter of the peripheral zones (9,9') of the sintered roller body can decrease continuously to zero from the side edges of the stator (2) to the two sides of the roller body (1). A reduced pressure of 60 to 90 mbar is delivered to the intake tube (3) through a standard radial fan (not shown). By contrast, known roller bodies of sintered metal having pore diameters of 2 to 5 μm require a pressure of up to 6 bar to achieve adequate torque conversion for the web-form material.

The cylindrical outside (17) of the roller body (1) is given the necessary smooth surface finish by a three-fold treatment comprising lathe-turning, grinding and polishing. This also has the advantage that the pore diameter at the surface of the roller body is somewhat smaller than in its interior so that dust and abrasion particles from the web which penetrate into the roller body are drawn under suction through the pores of the sintered material and discharged into the waste air. In addition, the three-fold treatment improves the surface finish of the roller body to such an extent that it is also suitable for the transport of extremely sensitive magnetic tape at high machine speeds. It has also been found that the relatively small pore diameter of the peripheral zones (9,9') of the roller body improves the adhesion of the web to the roller at its borders. Finally, the mechanical strength of the roller body in its peripheral zones is also increased in this way to receive the screwthreads for the fixing screws (7).

Figure 4:
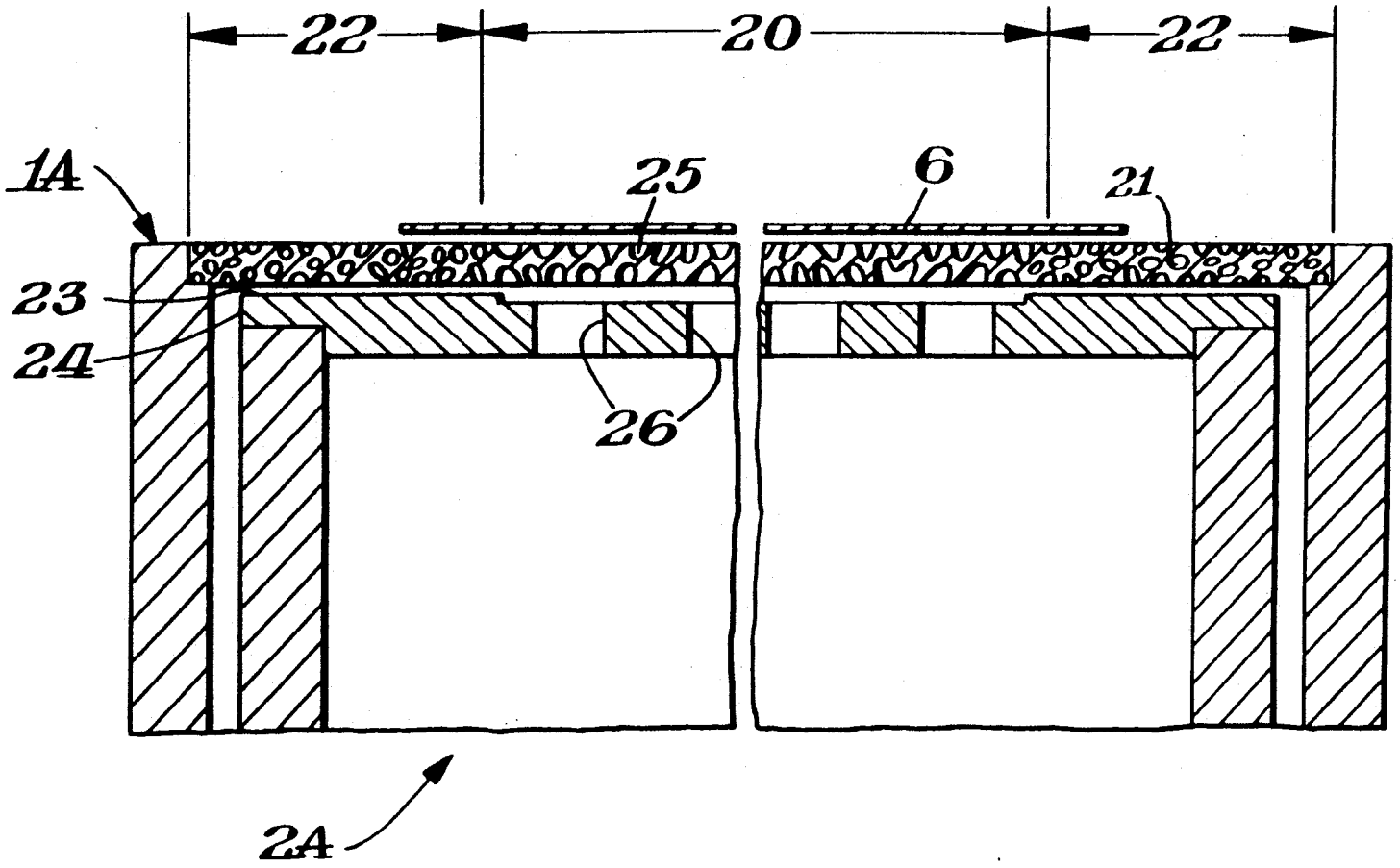
FIG. 4 is a longitudinal section through a roller arrangement showing zones of varying porosity.

FIG. 4 shows a roller body 1A having a sintered metal region 25 and a stator 2A having apertures 26 similar to apertures 10 of stator 2. A zone 23 with an absence of apertures is shown at an axial end 24 of the stator 2A, zones of varying porosity are delineated in FIG. 4 by central region 20 and side regions 22.

Tests have shown that a looping angle of the web around the roller of 180° to 300° and preferably 240° to 280° is suitable for transmitting a sufficiently high slip-free torque to the web.

The rollers according to the invention may be present at every possible station of a coating machine, for example at the casting station, before and after the drying station and the calendering station and at the winding station for the coated web. The web may be guided over the roller with its coated front side or with its coated or uncoated back in contact with the roller.

In one embodiment of the invention, the cylindrical surface of the sintered roller body had a width of 760 mm. A magnetic tape having a width of 650 mm and an overall thickness of 16 μm (flexible layer support of polyethylene terephthalate plus magnetic layer cast thereon) travelled over it at a speed of 340 m/minute. The reduced pressure in the interior of the stator was 75 mbar. The looping angle of the web was 260°. The pore diameter was 50 μm in the middle zone and 20 μm in each of the two 100 mm wide peripheral zones. The surface of the magnetic tape in contact with the roller showed no indentations or deformation and also no measurable abrasion and the pores of the roller did not become blocked, even after months of production.

Referring to FIG. 4 in the central region 20 the diameter of pores 25 is greater than the diameter of pores 21 in the side regions 22. The web 6 extends laterally over the central region 20 and side regions 22.

However, the invention is not confined to the described choice of material for the suction roller arrangement. In addition to sintered metal, sinterable plastics, for example polyimide, are also suitable.

What is claimed is:

1. A device for transmitting motion to a strip of material by looping a strip of material over a rotating member in a region to which suction pressure is applied, having in combination a cylindrically shaped hollow roller body, for rotating about an axis extending longitudinally through said body, having a porous sintered metal wall with an interior surface defining a chamber and pores extending radially through said wall from an outer surface to said interior surface and chamber, said pores through said wall provide zones of varying porosity positioned with respect to each other axially of the roller body, said zones consisting of a zone of greater permeability positioned in said body adjacent a zone of lesser permeability, wherein said zone of greater permeability has pores ranging in diameter from 35–70 um and the zone of lesser permeability has pores of a diameter of 30 um or less, a hollow stator positioned within the chamber of the roller body and having an inner chamber and a plurality of external surfaces on said stator formed to provide at each external surface a spacing from the interior surface of the roller body, said stator having in zones at said external surfaces apertures extending to the inner chamber and said stator having at least one zone absent of apertures at an axial end of the stator, means at aid aperture-containing zones for providing a suction force at said apertures upon rotation of the roller body, so constructed and arranged that the zone with the apertures is positioned radially within the zone of greater permeability.

2. The device as claimed in claim 1 in which the external surfaces of the stator in the aperture-containing zones has surfaces which form a polygon.

3. A device as claimed in claim 2, wherein the radial distance of the polygon forming surfaces of the stator from the roller body is approximately 10 mm and, at edges (16) of the polygon forming surface and sides (9, 9') of the roller body, from 0.1 to 0.3 mm.

4. A device as claimed in claim 1, wherein the roller body (1) is made of stainless VA sintered material while the stator (2) is made of aluminum.

5. The device as claimed in claim 1 having a web looped around the roller body.

6. A device as claimed in claim 5, wherein the looping angle of the web material around the roller is between 180° and 300°.

7. The device as claimed in claim 6 wherein the looping angle is between 240° and 280°.

8. The device as claimed in claim 5 in which the web overlies said zones of the roller body and a border of the web overlies a zone of lesser permeability.

9. The device as claimed in claim 8 wherein the transverse center of the web overlies the zone of greater permeability.

10. The device as claimed in claim 1 wherein the pore diameter in the porous sintered metal wall decreases continuously to zero from the boundary of the zone of greater permeability to the wall edge.

* * * * *